US006783448B2

(12) United States Patent
Sabo

(10) Patent No.: US 6,783,448 B2
(45) Date of Patent: Aug. 31, 2004

(54) FOAM BUFFING/POLISHING PAD

(76) Inventor: Gary L. Sabo, 16460 Brown La., Spring Lake, MI (US) 49456

( * ) Notice: Subject to any disclaimer, the term of this patent is extended or adjusted under 35 U.S.C. 154(b) by 0 days.

(21) Appl. No.: 10/160,375

(22) Filed: May 31, 2002

(65) Prior Publication Data

US 2003/0224706 A1 Dec. 4, 2003

(51) Int. Cl.[7] ..... B24B 23/00

(52) U.S. Cl. ..... 451/359; 451/527; 451/530; 451/495; 15/97.1

(58) Field of Search ..... 451/527–528, 451/495, 526, 530, 536, 538; 15/97.1, 230, 230.18, 230.19, 244.1, 526

(56) References Cited

U.S. PATENT DOCUMENTS 1,796,787 A * 3/1931 Hatfield ..... 15/97.1
2,229,745 A * 1/1941 Kneisley ..... 451/359
2,581,567 A * 1/1952 Wiley ..... 451/490
2,803,027 A * 8/1957 Cooke ..... 401/267
3,114,924 A * 12/1963 Morrison ..... 15/97.1
5,172,448 A * 12/1992 Kitahata ..... 15/230
5,181,291 A * 1/1993 Eairheart ..... 15/98
5,389,032 A * 2/1995 Beardsley ..... 451/359
5,527,215 A 6/1996 Rubino et al.
5,842,250 A * 12/1998 Zhadanov ..... 15/230.14
6,044,512 A 4/2000 Hornby et al.

* cited by examiner

*Primary Examiner*—George Nguyen
(74) *Attorney, Agent, or Firm*—Warn, Hoffmann, Miller & LaLone, P.C.

(57) ABSTRACT

A buffing/polishing pad that is designed so that the buffing or polishing compound or dressing does not saturate or load up in the central portion of the pad. A frustro-conical cut out at the center of the pad biases buffing material towards movement from the center of the pad toward an outer peripheral edge.

8 Claims, 2 Drawing Sheets

FOAM BUFFING/POLISHING PAD

BACKGROUND OF THE INVENTION

The present invention relates to foam buffing or polishing pads for rotary power buffing tools. More specifically, the present invention relates to an improved pad, a pad that is designed with a frustro-conical cut out in the central portion of the pad so that the polishing compound or dressing does not load up in the central portion as in prior pads, and a rounded outer edge to reduce scarring or marring of the finishing surface.

Buffing pads are known for use on finished surfaces, for example that of a vehicle, for smoothing, waxing and otherwise producing a finish or shine to the vehicle. Typically, when buffing out a vehicle, a buffing compound or polish is used. This compound generally includes a polishing grit, liquid base or paste solution.

In the typical art today, the buffing pad is attached to the buffing wheel as a single pad. These buffing pads tend to have a single planar surface from the radial inner most portions to the outer edges. Typically, in these operations, while the buffing material tends to be thrown out from the side edges, where centrifugal force acts most greatly on the material, it tends to build up or saturate the central area of the pad, where it does not get thrown out to the outside edge. For example, FIG. 5 shows buffing compound B, built up and saturated at the center of a prior art type buffing pad P. During buffing with these pads, the operator must often clean the compound from the center with a brush, called conditioning the pad. This build-up and saturation at the center creates problems during buffing of the vehicle surface and produces uneven results and excessive buffing time. Additionally, reconditioning the buffing pad takes time and is cumbersome, particularly at the center of the pad where the compound is hard to remove as the brush tends to rotate around the pad. Therefore, it is desirable in the art to solve the central loading up and re-dressing issues such that buffing may be more consistently accomplished.

Known foam buffs deal with the splashing, splattering or throwing outward of the buffing compound, or the issue of vibration, but none of them address the issue of the compound loading up in the center of the pad, or the compound reconditioning issues resulting from a planar pad. A pad patented by Rubino (U.S. Pat. No. 5,527,215) is a foam pad that introduces grooves or pathways in the foam in various configurations specifically to capture escaping finishing compound. Another pad patented by Hornby (U.S. Pat. No. 6,044,512) provides a concave working face that reduces vibration and compound splatter.

SUMMARY OF THE INVENTION

Therefore, in accordance with the present invention, there is provided a foam buffing pad for a rotary power buffing tool. The foam buffing pad has a thickness that allows for buffing of the surface without gouging or other problems. The density, weight and other characteristics of the pad will be dictated by the specific application. The working face of the present invention includes an outer periphery and a center portion. A chamfered edge is located on the buffing side outer periphery. A frustro-conical shape is cut out in the center portion, with the wider end toward the top buffing surface of the pad and the narrower end toward the back of the pad. The dimensions of the frustro-conical cut out will also be dictated by the specific application. The rear of the buffing pad of the present invention includes Velcro®, or other hook and loop, or mushroom-type fasteners for fastening the buffing pad to a rotary buffing device.

A further understanding of the present invention will be had in view of the description of the drawings and detailed description of the invention, when viewed in conjunction with the subjoined claims.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
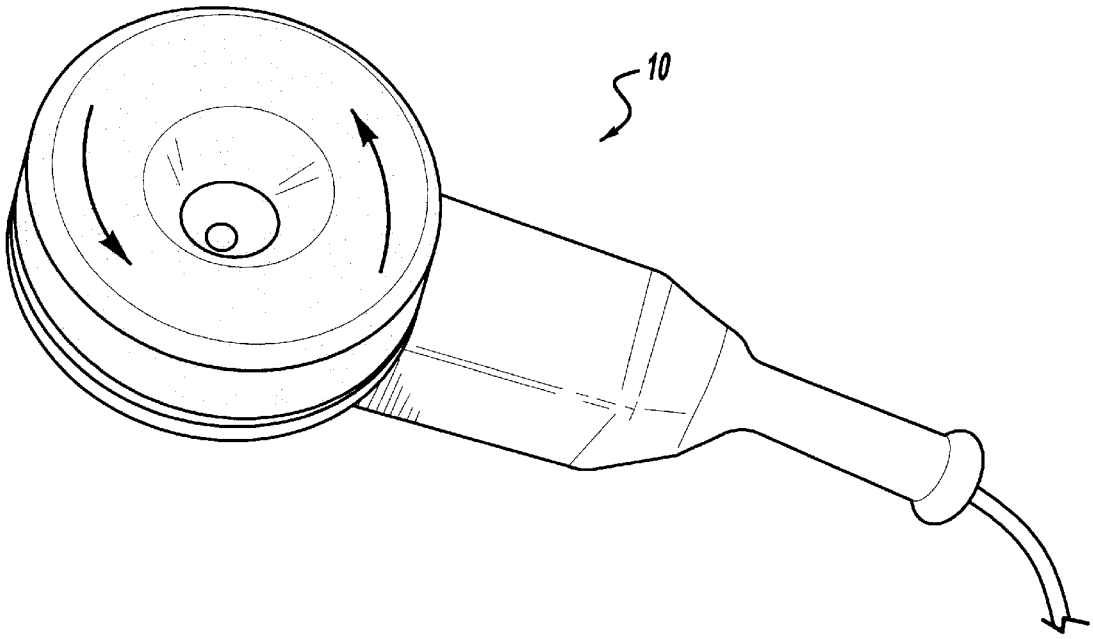
FIG. 1 is a perspective view of the buffing pad of the present invention.
Figure 2:
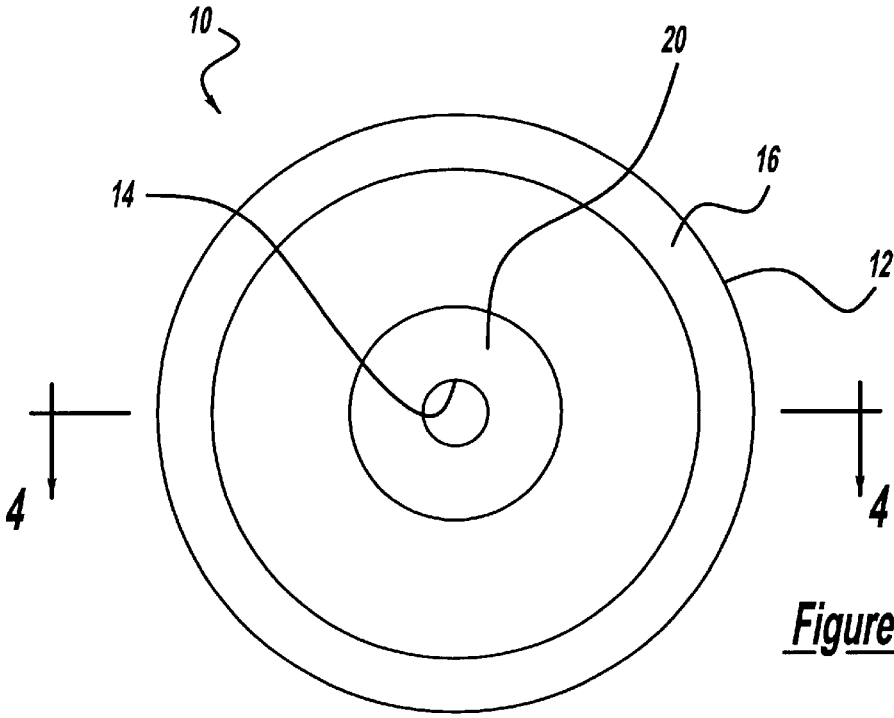
FIG. 2 is a front view of the buffing pad.
Figure 3:
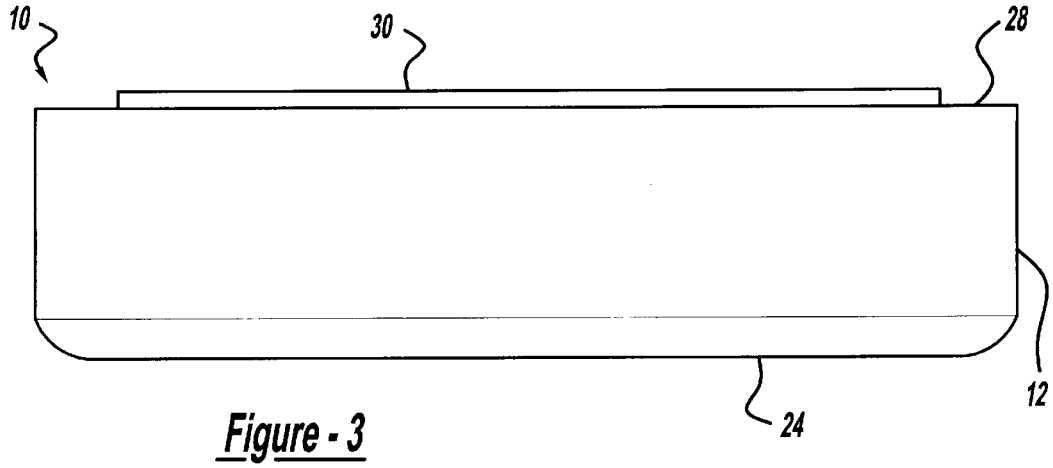
FIG. 3 is a side view of the buffing pad.
Figure 4:
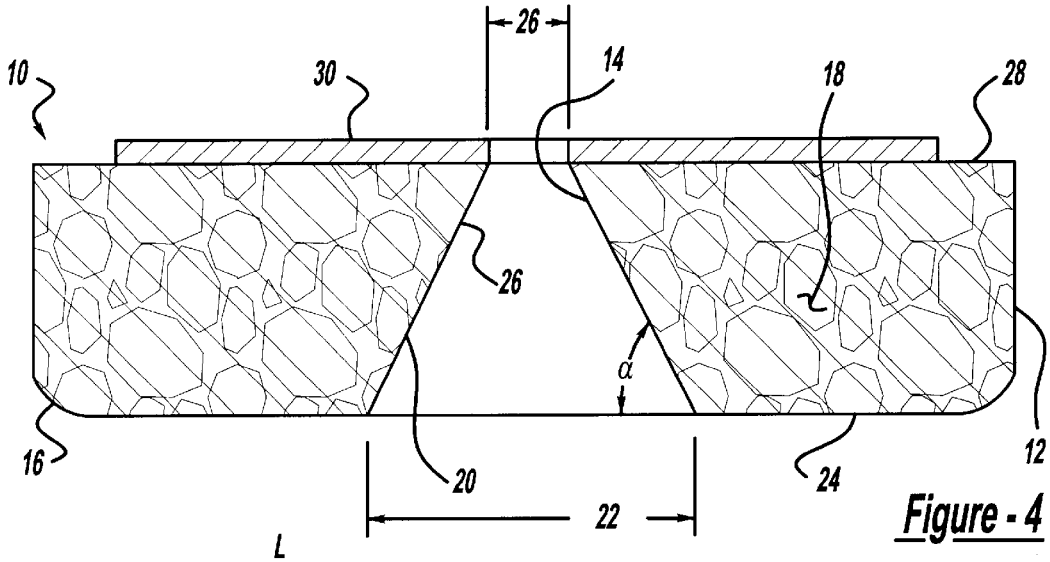
FIG. 4 is a sectional view along line 4—4 of FIG. 2, showing the chamfered edge and the frustro-conical cut out in the center of the buffing pad.
Figure 5:
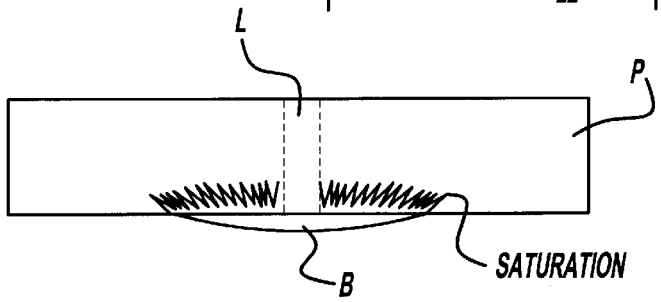
FIG. 5 is a side view of an existing prior art buffing pad showing buffing compound build up and saturation of the central portion.

The following description of the preferred embodiment(s) is merely exemplary in nature and is in no way intended to limit the invention, its application, or uses.

Thus, in accordance with the present invention, there is provided a foam buffing pad that does not saturate or build up buffing compound in the center of the pad. Buffing pad 10 includes an outer periphery 12 and a center portion 14. Buffing pad 10 is, preferably made from soft, non-marring foam material 18, but it may also be of another like material as will be appreciated by those skilled in the art. In the present invention, the center portion 14 includes a hollowed out in a frustro-conical shape in order to prevent loading up of compound in the center of the pad. The outer periphery 12 includes a chamfered edge 16. This allows for the foam to not burn or cut into the surface being polished and for buffing compound to not build up at the edge also. The central portion 14 includes a frustro-conical surface 20 thereon. The frustro-conical surface 20 allows any compound material that is at the center to move by centrifugal force outward to the edge of the pad, where it will be effectively dispersed for buffing of the finish. Thus, the pad has a wider portion 22 of the frustro-conical portion toward the working face 24 of the pad, and a narrower portion 26 of the frustro-conical portion at the back portion 28 of the pad. The chamfered edge 16 is at an angle "b" of about 35 degrees.

The frustro-conical cut out portion may generally have an angle "a" of from about 35 to about 75 degrees, and preferably from about 55 to about 65 degrees. In a preferred embodiment, the angle is at about 55 degrees. While the central center portion 14 is shown as a well defined frustro-conical portion 20, with defined edges, the edges could also be rounded.

While the frustro-conical cut out portion of the present invention is shown in a particular pad environment, it will be readily appreciated by those skilled in the art that this type of cut out will be useful in other designs of buffing pads.

Figure 6:
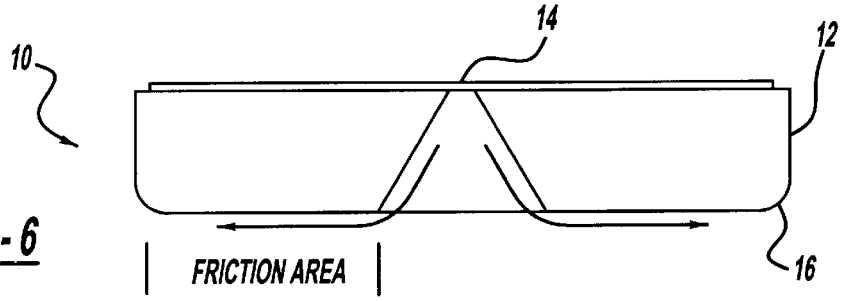
FIG. 6 is a side view of the pad of the present invention, illustrating dispersal of the buffing compound onto the working portion of the pad.

Thus, in accordance with the present invention, the buffing compound may be provided at the center of the pad or at the pad edges, and it works itself outwardly, by way of centrifugal force, onto the frictional area of the pad, as shown in FIG. 6. As shown herein, the frictional area is a substantially planar work area of the pad which performs the polishing function. The pad of the present invention does not saturate or build up buffing compound material in the center of the pad and, therefore, reduces reconditioning of the pad by the operator and is more effective and efficient for use by those in the art. Therefore, the present invention provides a useful improvement over the buffing pads used in the prior art.

Those skilled in the art can now appreciate from the foregoing description that the broad teachings of the present invention can be implemented in a variety of forms. Therefore, while this invention has been described in connection with particular examples thereof, the true scope of the invention should not be so limited, since other changes and modifications will become apparent to the skilled practitioner upon a study of the drawings, specification and following claims.

What is claimed is:

1. A buffing pad for use on a rotary powered buffer apparatus comprising:

a resilient buffing pad body including a working face and a backing portion, said working face having an outer periphery and a central portion; and an outward slanted surface provided at said central portion of the pad for facilitating outward dispersion of buffing compound onto a friction area of the pad;

wherein said outward slanted surface comprises a hollowed out frustro-conical shape through the center of the pad with the wider part of the conical frustum at the working face of the pad and the narrower portion at the rear or mounting surface of the pad, which prevents build up and saturation of compound at the center of the pad by utilizing centrifugal force to spread buffing compounds outward from the center;

wherein said hollowed out frusto-conical shape extends through said resilient buffing pad body from said backing portion to said working face.

2. The buffing pad in accordance with claim 1, wherein said resilient buffing pad body is made of a foam material.

3. The buffing pad in accordance with claim 1, wherein the outer periphery is rounded.

4. The buffing pad in accordance with claim 1, wherein said backing portion further includes a hook and loop fastener for attachment to a rotary powered buffer apparatus.

5. A buffing pad for use on a rotary powered buffing apparatus comprising:

a resilient buffing pad body including a working face and a backing portion, said working face having an outer periphery and a central portion; and a frustro-conical surface formed at said central portion with the wider portion of the conical frustum at the working face of the pad, whereby build-up of material at the center of said pad is prevented by said frustro-conical surface biasing any buffing material in the center toward movement onto the friction area of the pad;

wherein said frusto-conical surface extends through said resilient buffing pad body from said backing portion to said working face.

6. The buffing pad of claim 5 wherein the outer periphery has a rounded edge.

7. The buffing pad of claim 5 wherein the resilient buffing pad body is made from a foam material.

8. The buffing pad of claim 5 wherein a hook and loop fastener material is attached to the backing portion for attachment of the pad to the rotary powered buffer apparatus.

* * * * *